US007393260B2

(12) United States Patent
Yamaguchi

(10) Patent No.: US 7,393,260 B2
(45) Date of Patent: Jul. 1, 2008

(54) REMOTE-CONTROLLABLE TOY AND EXTENSION UNIT THEREOF

(75) Inventor: Takashi Yamaguchi, Tokyo (JP)

(73) Assignee: Konami Corporation, Chiyoda-Ku, Tokyo (JP)

( * ) Notice: Subject to any disclaimer, the term of this patent is extended or adjusted under 35 U.S.C. 154(b) by 606 days.

(21) Appl. No.: 10/506,110

(22) PCT Filed: Jan. 16, 2004

(86) PCT No.: PCT/JP2004/000345

§ 371 (c)(1),
(2), (4) Date: Oct. 6, 2004

(87) PCT Pub. No.: WO2004/064968

PCT Pub. Date: Aug. 5, 2004

(65) Prior Publication Data

US 2005/0106994 A1 May 19, 2005

(30) Foreign Application Priority Data

Jan. 17, 2003 (JP) ..... 2003-010460

(51) Int. Cl.
*A63H 30/00* (2006.01)

(52) U.S. Cl. ..... 446/456; 446/454

(58) Field of Classification Search ..... 446/454, 446/456

See application file for complete search history.

(56) References Cited

U.S. PATENT DOCUMENTS 5,024,626 A 6/1991 Robbins et al.
5,195,920 A * 3/1993 Collier ..... 446/409
5,334,075 A * 8/1994 Kakizaki et al. ..... 446/438
6,439,956 B1 8/2002 Ho et al.

FOREIGN PATENT DOCUMENTS

| | | | |
|---|---|---|---|
| CA | 2263354 | | 2/1998 |
| CN | 2476318 | Y | 2/2002 |
| JP | 62-92894 | A1 | 6/1987 |
| JP | 02-049683 | A1 | 2/1990 |
| JP | 6-39097 | A1 | 5/1994 |
| JP | 7-17299 | A1 | 3/1995 |
| JP | 2001-025581 | A1 | 1/2001 |
| JP | 2001-300138 | A1 | 10/2001 |
| WO | 9806472 | | 2/1998 |

OTHER PUBLICATIONS

Uramen of Kokokuyo Bira, "Digi Q Formula", Konami 2002.

* cited by examiner

*Primary Examiner*—Robert E Pezzuto
*Assistant Examiner*—Alex F. R. P. Rada, II
(74) *Attorney, Agent, or Firm*—Darby & Darby P.C.

(57) ABSTRACT

A controller (2) which transmits code signals in accordance with operation contents of a user, a drive unit (1) driven and controlled based on the code signals, and an extension unit (10) detachably mounted on the controller (2) are provided. A code signal obtaining device (31, 51, and 52) for obtaining the code signals output from the controller (2) and a process performing device (30 and 61) for deciding a state of the drive unit (1) based on the obtained code signals to perform a predetermined process based on the decision result are provided in the extension unit (10).

5 Claims, 13 Drawing Sheets

REMOTE-CONTROLLABLE TOY AND EXTENSION UNIT THEREOF

TECHNICAL FIELD

The present invention relates to a remote-controlled toy in which a drive unit is driven and controlled by code signals transmitted from a controller.

BACKGROUND ART

As to the remote-controlled toy in which the drive unit is driven by the code signals transmitted from the controller, many remote-controlled toys have been already known. The controller includes drive information for the drive unit, which can control the drive such as a running direction or running speed of the drive unit.

However, in the conventional remote-controlled toys, the code signals are transmitted with no sound from the controller, and the code signals are invisible, so that there is poor in realistic feeling. Since the game is going on with no sound, it is lacking in enthusiasm. Further, it is not easy to incorporate a function of producing effect of transmit operation in a transmitter which already exists.

DISCLOSURE OF THE INVENTION

In view of the foregoing, it is an object of the invention to provide the remote-controlled toy which can enhance the feeling of operating the controller by performing the production such as sound effect so that a player can realize his/her operation on the side of the controller and which can easily perform the production even if the transmitter has been already produced.

A remote-controlled toy of the invention comprises a controller which transmits code signals in accordance with operation contents of a user, a drive unit to be driven and controlled based on the code signals, and an extension unit detachably mounted on the controller, wherein a code signal obtaining device for obtaining the code signals output from the controller and a process performing device for deciding a state of the drive unit based on the obtained code signals to perform a predetermined process based on the decision result are provided in the extension unit. Therefore, the above-described problem is solved.

According to the invention, even if a controller already exists since before, if the extension unit is mounted on the controller, the extension unit can decide how the drive unit is in control state, e.g. the drive unit is accelerated or stopped, by receiving the code signals transmitted from the controller to know which direction is given to the drive unit. Performing the production corresponding to the control state can give the realization that the player has directed the operation to the player and give impression for the game.

It is also possible that the controller has a transmission portion for transmitting the code signals, and the code signal obtaining device has a reception portion arranged opposite to the transmission portion to receive the code signals transmitted from the transmission portion. Therefore, even if an output terminal is absent, the code signals output toward the drive unit can be obtained to perform a process corresponding to the signals.

It is also possible that a terminal portion which outputs the code signals is provided in the controller, and the code signal obtaining device is connected to the terminal unit with a wire. Therefore, the extension unit can obtain the code signals transmitted from the controller with the wire, and the code signals can be more securely obtained than the wireless connection. In the case where the controller originally has the terminal portion, the terminal portion can be used for the connection.

It is also possible that a charging dock which has a charging terminal to supply electric power for charge to the drive unit is provided in the controller, the charging dock being able to hold the drive unit while the charging terminal is electrically connected to the drive unit, and the extension unit can be mounted on the charging dock.

Therefore, the charging dock existing in the conventional controller can be utilized as a region where to mount the extension unit, and it is not necessary to provide a special region for mounting the extension unit to the conventional controller.

It is also possible that the extension unit is adapted to be able to be mounted on the controller so as to hide the charging terminal, and an extension circuit is provided in the extension unit, the extension circuit connecting the charging terminal of the controller and an extension charging terminal provided at a position of the extension unit which is exposed outside when the extension unit is mounted on the charging dock. Therefore, similarly to the conventional remote-controlled toys, the drive unit can be charged without detaching the extension unit from the charging dock.

It is also possible that the extension unit has an amplifying device for amplifying and transmitting the code signals output from the controller. Therefore, production functions such as booster function and sound output can be realized in one extension unit.

It is also possible that the predetermined process includes output of a sound or an image according to a state of the drive unit. This enables the sound effect and the image to be output as means for producing the operation direction to the drive unit. For example, when the player directs the drive unit to increase speed, the production such as the enhancement of engine sound can be performed.

An extension unit for a remote-controlled toy, the remote-controlled toy including a controller which transmits code signals in accordance with operation contents of a user and a drive unit to be driven and controlled based on the code signals, the extension unit being detachably mounted on the controller, comprises a code signal obtaining device for obtaining the code signals output from the controller, and a process performing device for deciding a state of the drive unit based on the obtained code signals to perform a predetermined process based on the decision result. Therefore, the above-described problem is solved.

The remote-controlled unit according to claim 1 can be realized by the extension unit.

BEST MODE FOR CARRYING OUT THE INVENTION

Figure 1:
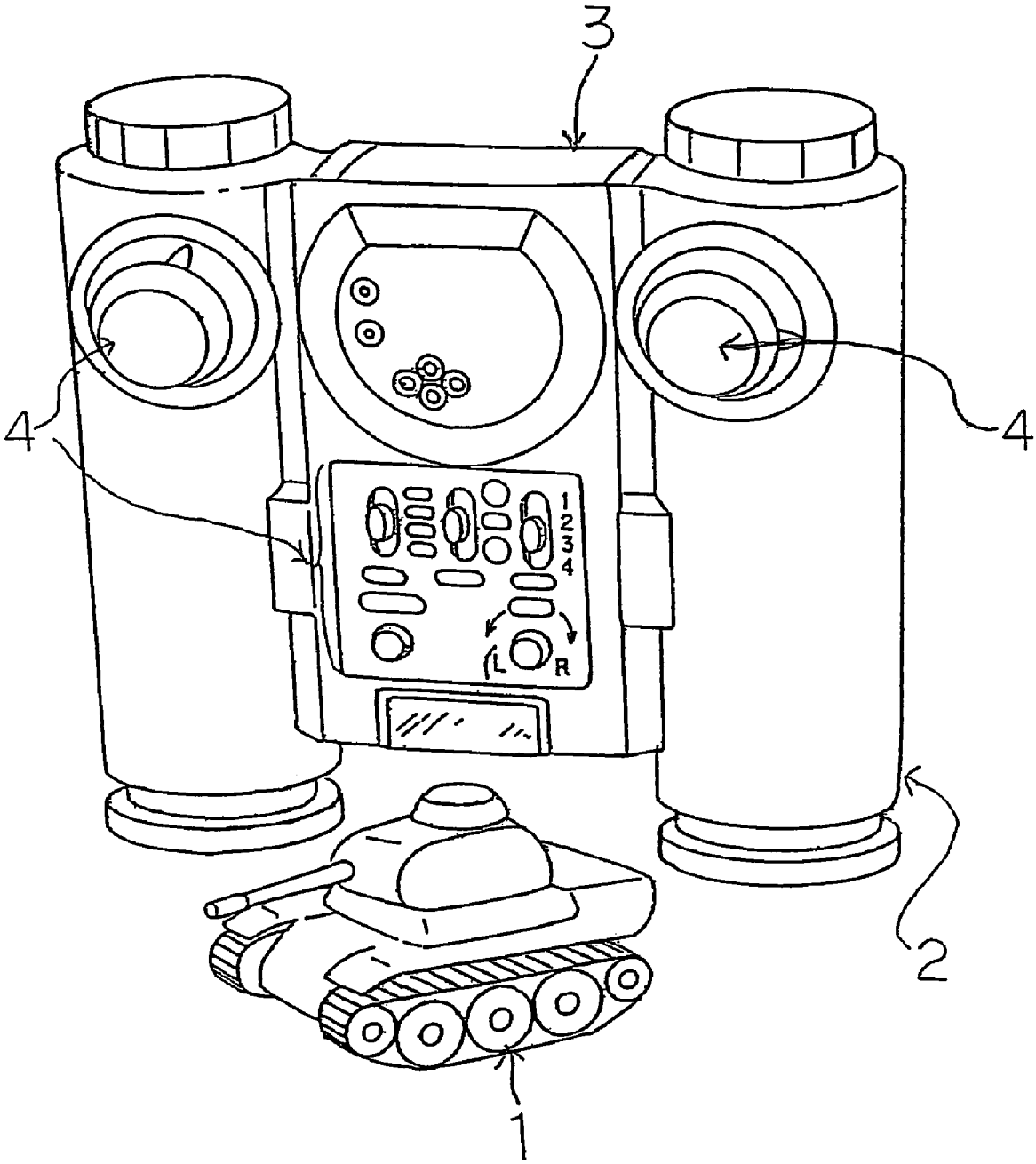
FIG. 1 shows an example of the first embodiment.

FIG. 1 shows an example of the first embodiment of the invention. A tank 1 as the drive unit is remote-controlled by a controller 2. A transmission portion 3 and various input devices 4 . . . 4 are provided in the controller 2. The transmission portion 3 transmits code signals for directing action of the tank 1 and the various input devices 4 . . . 4 are provided to direct the action of the tank 1. Data transmission is performed with infrared rays. The tank 1 and the controller 2 combined with the tank 1 have the same ID code. The controller 2 transmits the code signals including the ID code of the controller 2, and the tank 1 recognizes the received code signals as the code signals transmitted to the tank 1 when the received code signals include the same ID code as the tank 1.

Figure 2:
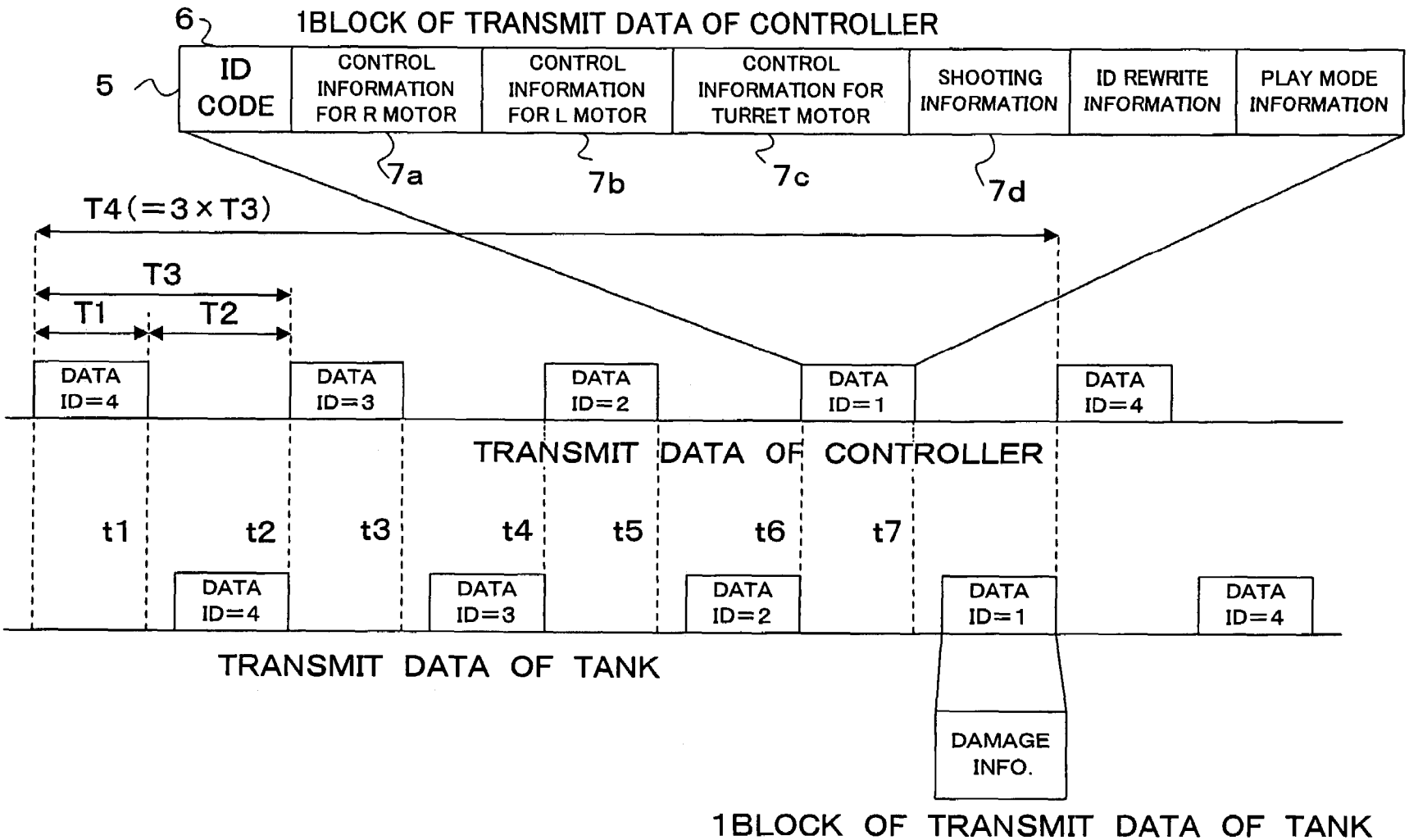
FIG. 2 shows an example of transmit data of the first embodiment.

FIG. 2 shows transmit data 5 as an example of the code signals transmitted from the controller 2. The transmit data 5 includes an ID code 6 and pieces of operation direction data 7*a*, 7*b*, 7*c*, and 7*d* (hereinafter referred to as operation direction data 7*a* to 7*d*). The ID code 6 is the ID code of the controller 2. Control information corresponding to operation of a player is set in the operation direction data 7*a* to 7*d*, and a blank or the code indicating no direction is set in the operation direction data 7*a* to 7*d* with respect to the operation in which the player does not give the direction. The transmit data 5 is transmitted in accordance with the transmit timing given to each ID code so that the pieces of the data of each ID code do not interfere with one another. The transmit timing is controlled in the controller 2. For example, in FIG. 2, the data can be started to transmit with a period of T3×3 for the data of ID=4.

Figure 3:
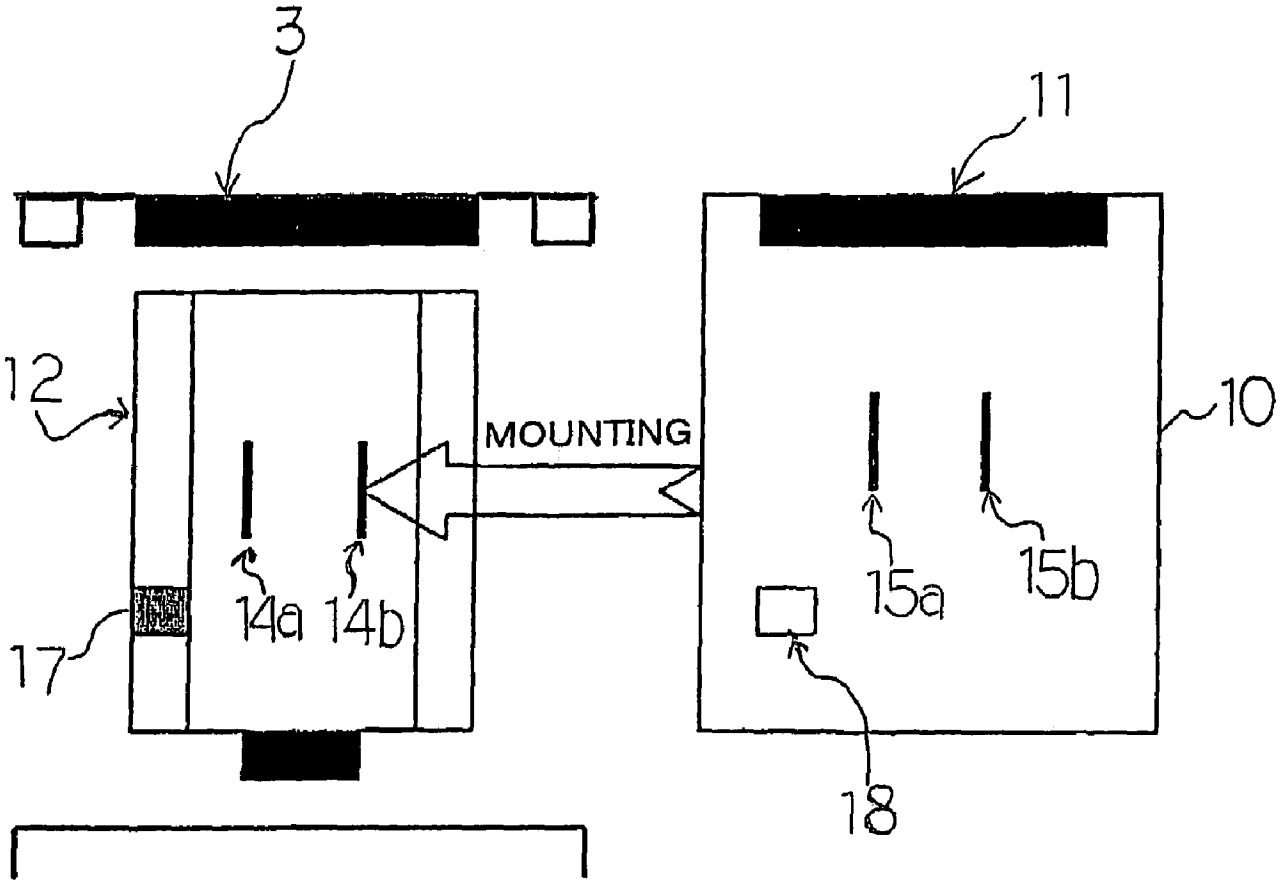
FIG. 3 shows an extension unit and a charging dock of the first embodiment.

A charging dock 12 shown in FIG. 3 is provided on a backside of the controller 2, and an extension unit 10 is detachably mounted on the charging dock 12. The charging dock 12 is a region where the charge for the tank 1 is performed. Charging terminals 14*a* and 14*b* and a rewrite data output region 17 for outputting ID rewrite data are provided in the charging dock 12. The tank 1 can be mounted on the charging dock 12. The charge for the tank 1 is performed through the charging terminal 14*a* and 14*b* when the tank is mounted on the charging dock 12. The rewrite data output region 17 is one to which the data for rewriting the ID code of the tank 1 is output.

A light reception portion 11 as a code signal obtaining device, an extension charging terminals 15*a* and 15*b*, and an extension output region 18 are provided in the extension unit 10. The light reception portion 11 is provided so as to be arranged opposite to the transmission portion 3 of the controller 2 when the extension unit 10 is mounted to the controller 2. The extension charging terminals 15*a* and 15*b* and the extension output region 18 are provided on the side opposite to the side on which the extension unit 10 is mounted on the charging dock 12. The extension charging terminals 15*a* and 15*b* and the extension output region 18 are provided so as to be located in a vertical direction of each of the charging terminals 14*a* and 14*b* and the rewrite data output region 17 when the charging dock 12 is placed beneath the extension unit 10.

Figure 4:
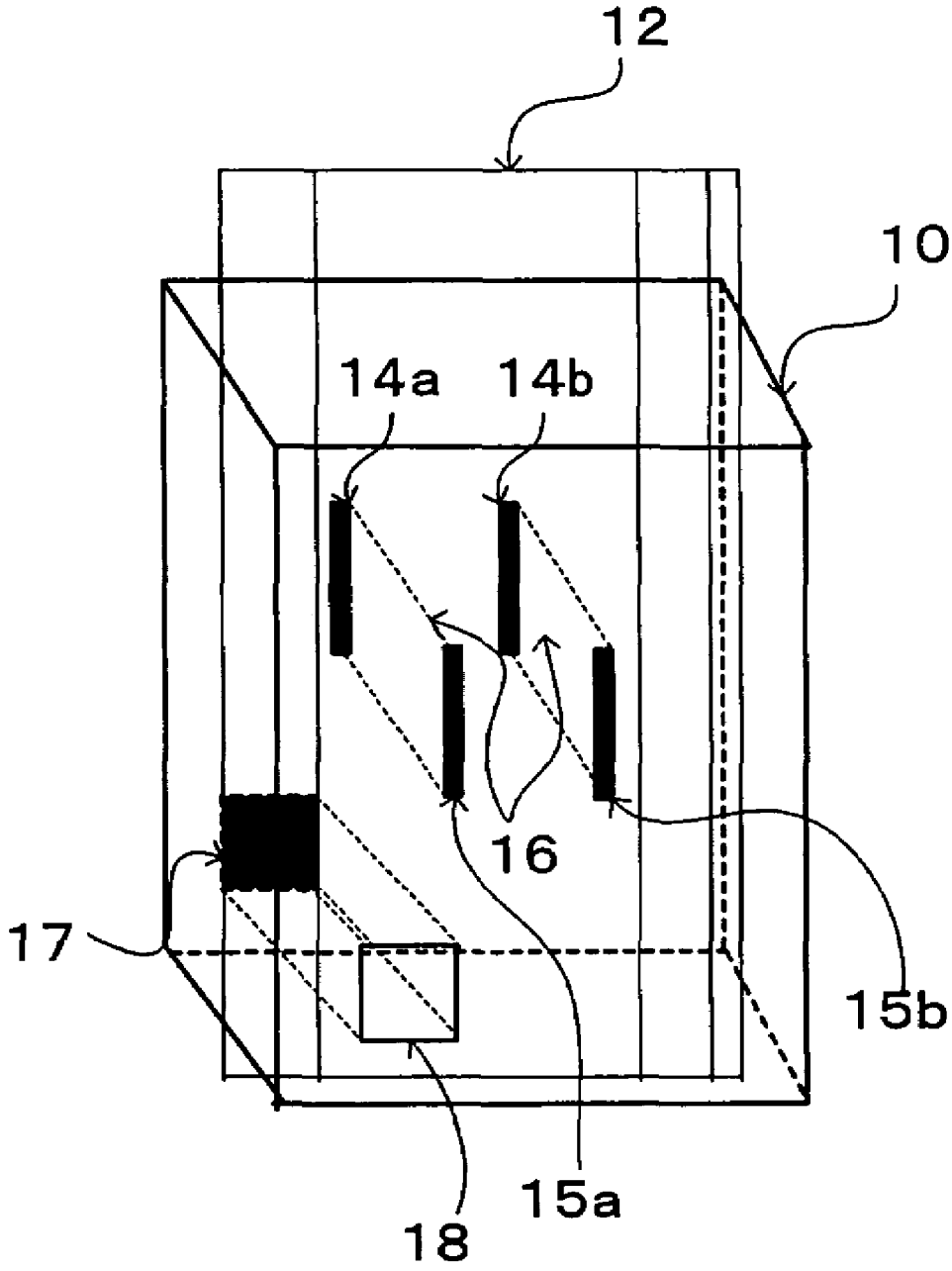
FIG. 4 shows a state in which the extension unit is mounted on the charging dock.

FIG. 4 shows a state in which the extension unit 10 is mounted on the charging dock 12. The extension unit 10 is illustrated in front in a rectangular solid shape, and the charging dock 12 is located behind the extension unit 10. The charging terminals 14*a* and 14*b* of the charging dock 12 is connected to the extension charging terminals 15*a* and 15*b* of the extension unit 10 by an extension circuits 16 included in the extension unit 10. This allows the extension charging terminals 15*a* and 15*b* to realize a function of the charging terminals 14*a* and 14*b*. Therefore, the tank 1 can be mounted on the side where the extension charging terminals 15*a* and 15*b* of the extension unit 10 are provided.

Similarly to the charging terminals 14*a* and 14*b*, the rewrite data output region 17 is also connected to the extension output region 18 by the extension circuit, which allows the extension output region 18 to realize the function of the rewrite data output region 17.

In the case where there is any region which does not accomplish its function because the region is hidden by mounting the extension unit 10, an extension circuit and an extension region corresponding to the function of the region may be provided in the extension unit 10.

Figure 5:
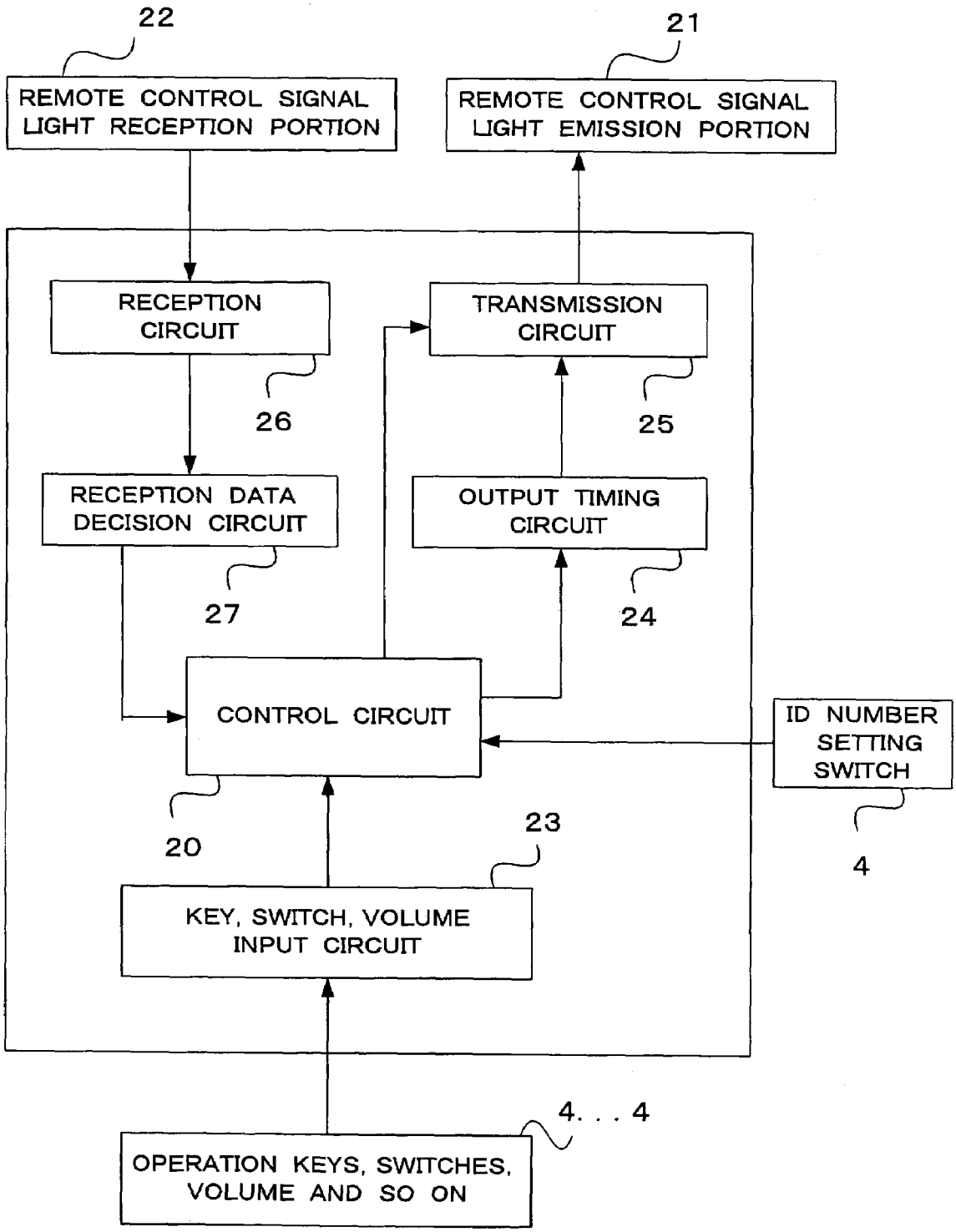
FIG. 5 shows a configuration of a controller of the first embodiment.

Then, a circuit configuration of the controller 2 will be described referring to FIG. 5. An input circuit 23 detects the operation input to the input devices 4 . . . 4 to transmit operation signals according to the operation state to a control circuit 20. In the control circuit 20, the transmit data 5 is produced in accordance with the operation signals. The transmit data 5 is transmitted to an output timing circuit 24. In the case where it is decided that the own transmit timing comes, the transmit data 5 is transmitted to a remote control signal light emission portion 21 through a transmission circuit 25. The remote control signal light emission portion 21 transmits the transmit data 5 from the transmission portion 3 with the infrared rays. A remote control signal light reception portion 22 receives the transmit data 5 transmitted from the other controller 2. The received transmit data 5 is sent to the control circuit 20 through a reception circuit 26 and a reception data decision circuit 27 to control the own transmit timing.

Figure 6:
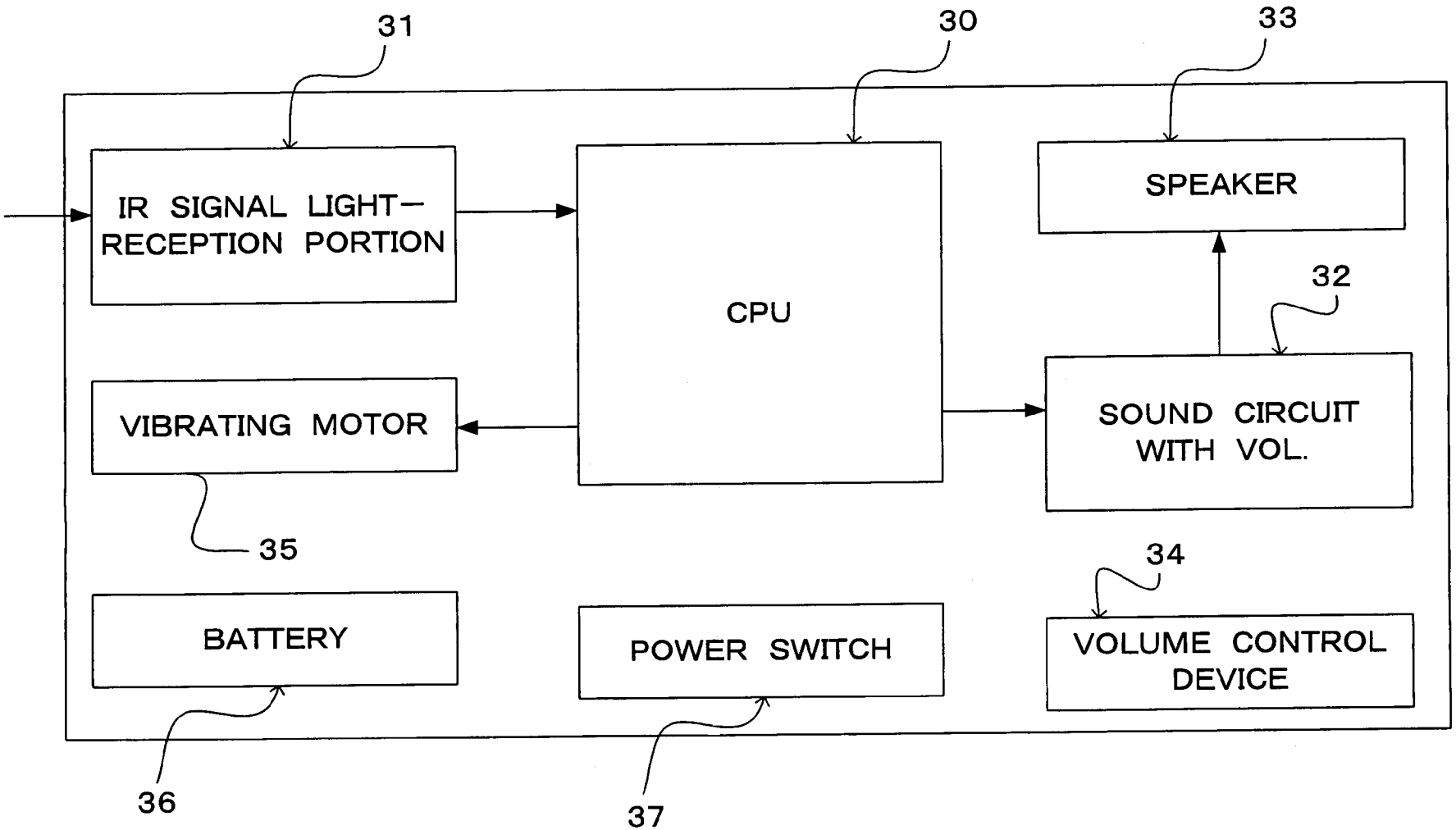
FIG. 6 shows the configuration of the extension unit of the first embodiment.

FIG. 6 shows the circuit configuration of the extension unit 10. The electric power is supplied to the extension unit 10 by a battery 36. Turning a power switch 37 on causes each of the following circuits to become workable. The extension unit 10 has a control circuit 30, an IR signal light-reception portion 31, a sound circuit 32, a speaker 33, a volume control device 34, and a vibrating motor 35. The IR signal light-reception portion 31 as the code signal obtaining device receives the transmit data 5 transmitted from the controller 2 to send the transmit data 5 to the control circuit 30 as the process performing device. The sound circuit 32 and the vibrating motor 35 are connected to the control circuit 30. The control circuit 30 decodes the operation direction data 7*a* to 7*d* of the transmit data 5, produces control data for making the sound and vibration corresponding to the operation directions, and sends the control data to the sound circuit 32 and the vibrating motor 35 respectively. The sound circuit 32 produces sound data, in which noise is eliminated from a PCM sound source or an FM sound source, based on the control data sent from the control circuit 30. The sound data is output as the sound through the speaker 33. A volume level of the output sound can be controlled by the volume control device 34. The vibrating motor 35 is a motor to vibrate the extension unit 10. The vibrating motor 35 is driven in accordance with the control data sent from the control circuit 30. The sound effect associated with the action of the tank 1 includes firing sound, the engine sound associated with right or left turning, the engine sound associated with acceleration or deceleration, and the like. It is also possible to change the type of vibration in accordance with those actions.

Figure 7:
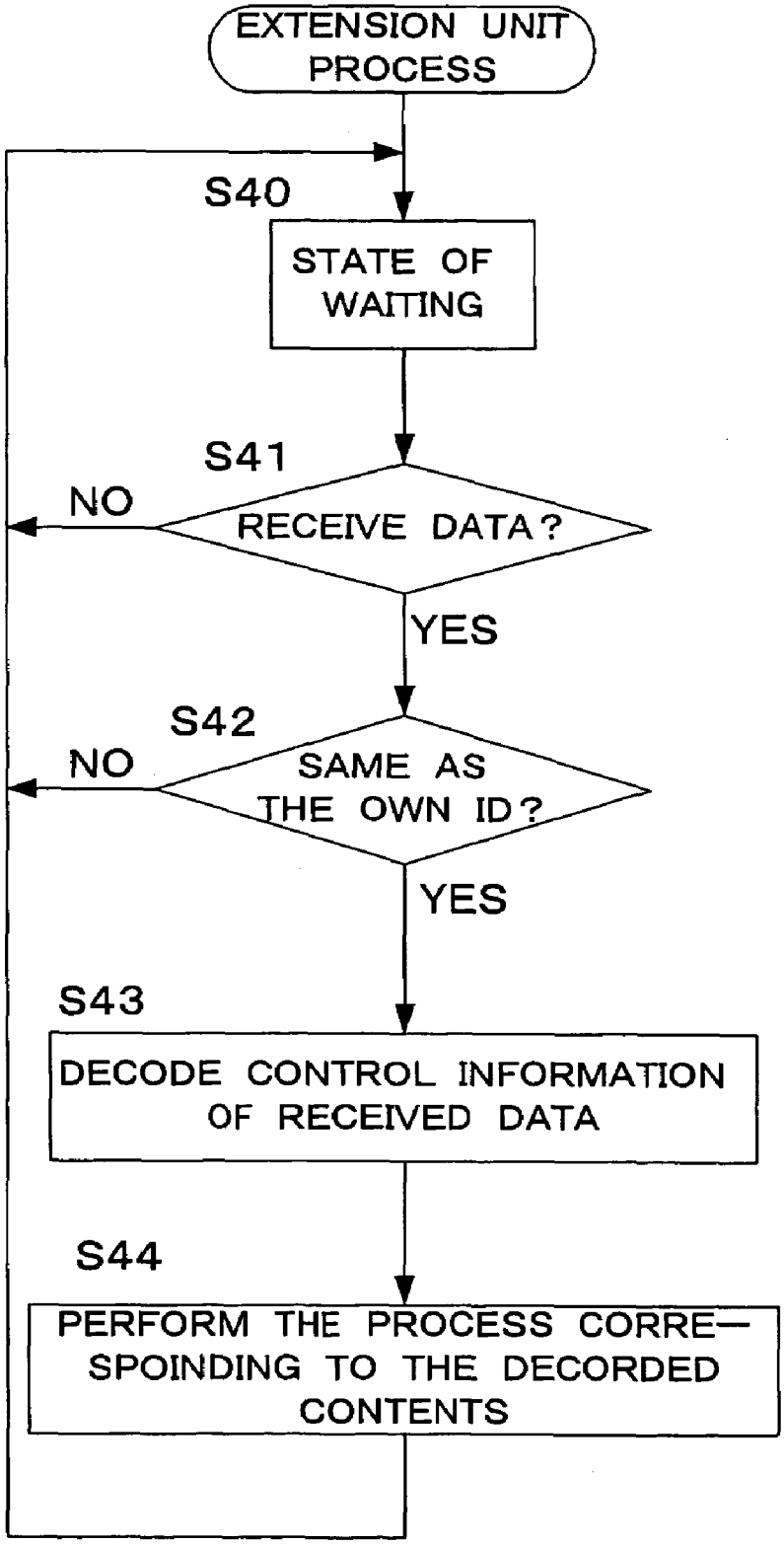
FIG. 7 is a flow chart showing a flow of a process performed by a control circuit of the extension unit of the first embodiment.

Then, a flow of the process performed by the control circuit 30 will be described referring to FIG. 7. When the power switch 37 is turned on, the control circuit 30 repeats a state for waiting receiving the transmit data 5 (Step S40) and a state for deciding whether the transmit data 5 has been received or not (Step S41). When the transmit data 5 has been received, the process proceeds to Step S42. In Step S42, when the ID code 6 of the transmit data 5 does not equal to the own ID code, the process returns to Step S40. When the ID code 6 of the transmit data 5 equals to the own ID code, the process proceeds to Step S43. In Step S43, the control circuit 30 decodes contents of the operation direction data 7*a* to 7*d* of the received transmit data 5. After the decoding, the process proceeds to Step S44, and the control circuit 30 causes the sound circuit 32 and the vibrating motor 35 to perform the process corresponding to the received operation direction data 7*a* to 7*d*. Then, the process returns to Step S40 to be in the reception waiting state.

Figure 8:
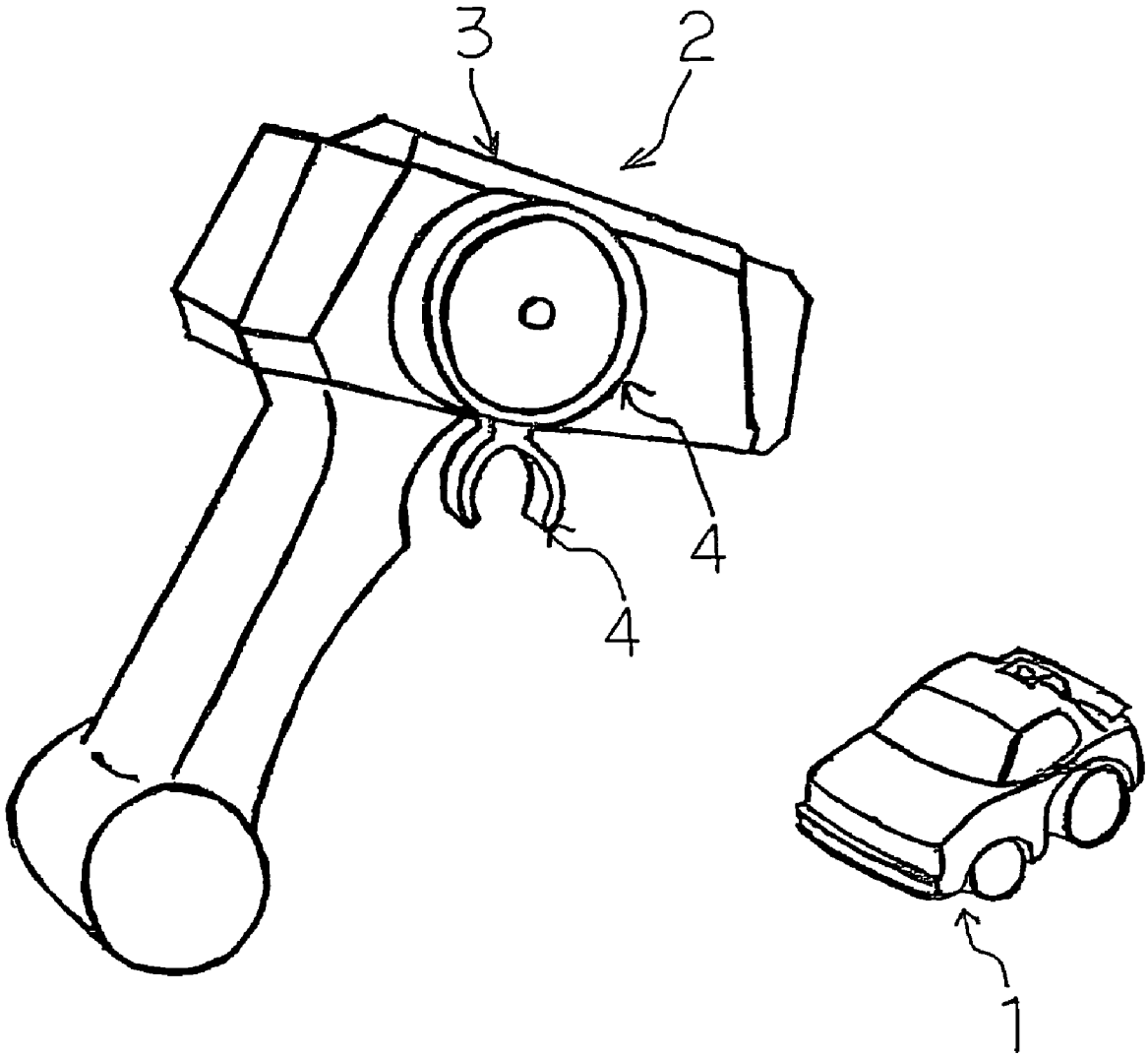
FIG. 8 shows an example of the second embodiment.

FIG. 8 shows an example of the second embodiment of the invention. A running car 1 as the drive unit is remote-controlled by a controller 2. A transmission portion 3 and various input devices 4 . . . 4 are provided in the controller 2. The transmission portion 3 transmits code signals for directing the action of the running car 1 and the various input devices 4 . . . 4 are provided to direct the action of the tank 1. An output terminal 50 which can output the code signals is also provided in addition to the transmission portion 3. The data transmission is performed with the infrared rays. The running car 1 and the controller 2 combined with the running car 1 have the same ID code. The controller 2 transmits the code signals including the own ID code, and the running car 1 recognizes the code signals including the same ID code as the running car 1 in the received data as the code signals transmitted to the tank 1.

Figure 9:
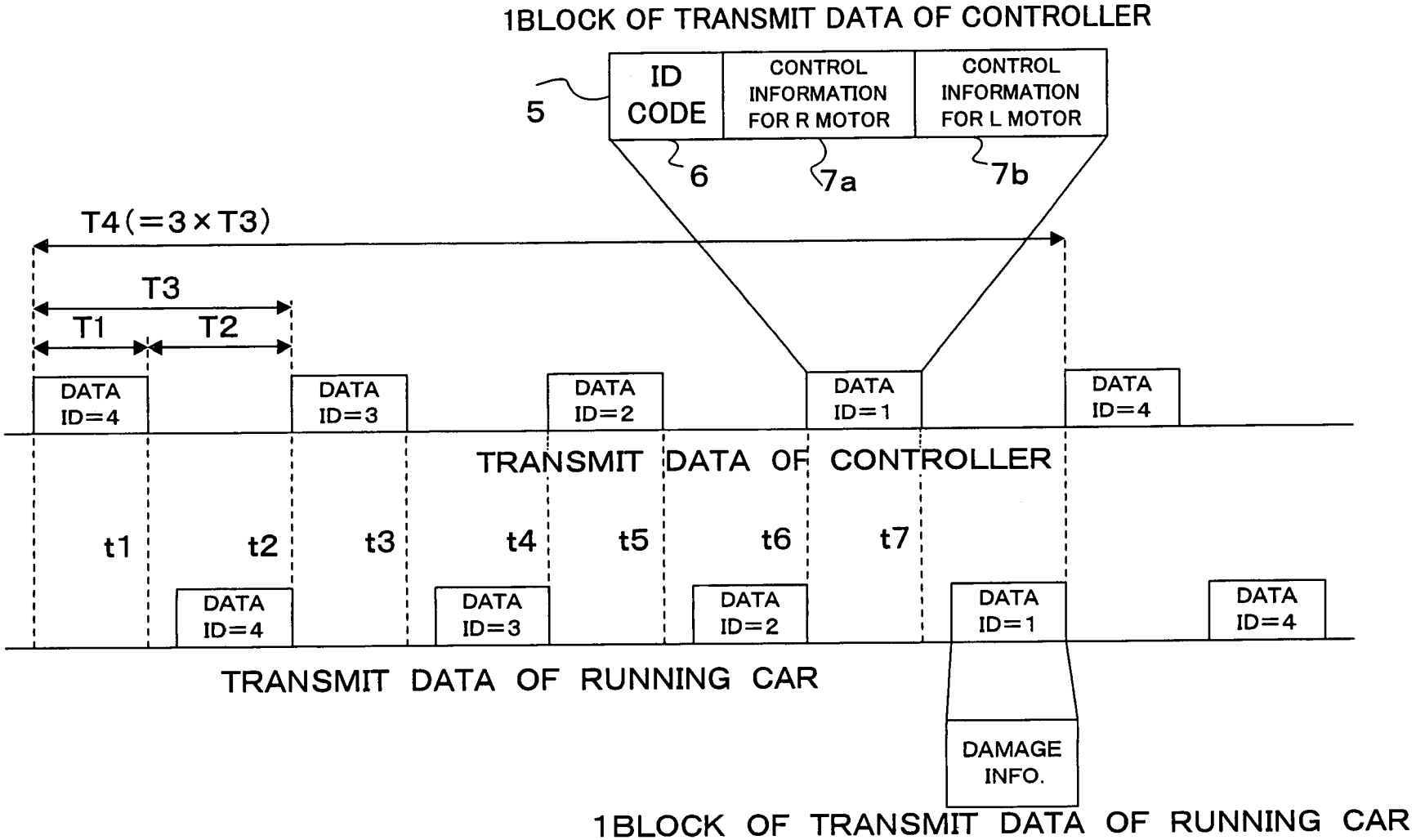
FIG. 9 shows an example of the transmit data of the second embodiment.

FIG. 9 shows transmit data 5 as an example of the code signals transmitted from the controller 2. The transmit data 5 includes an ID code 6 and pieces of operation direction data 7*a* and 7*b*. The ID code 6 is the ID code of the controller 2. The control information corresponding to the operation of the player is set in the operation direction data 7*a* and 7*b*.

In order to prevent the pieces of the transmit data of each ID code with one another, the transmit data 5 is transmitted in accordance with a transmit timing given to each ID code. The transmit timing is controlled in the controller 2. For example, in FIG. 9, the data can be started to transmit with the period of T3×3 for the data of ID=4.

Figure 10:
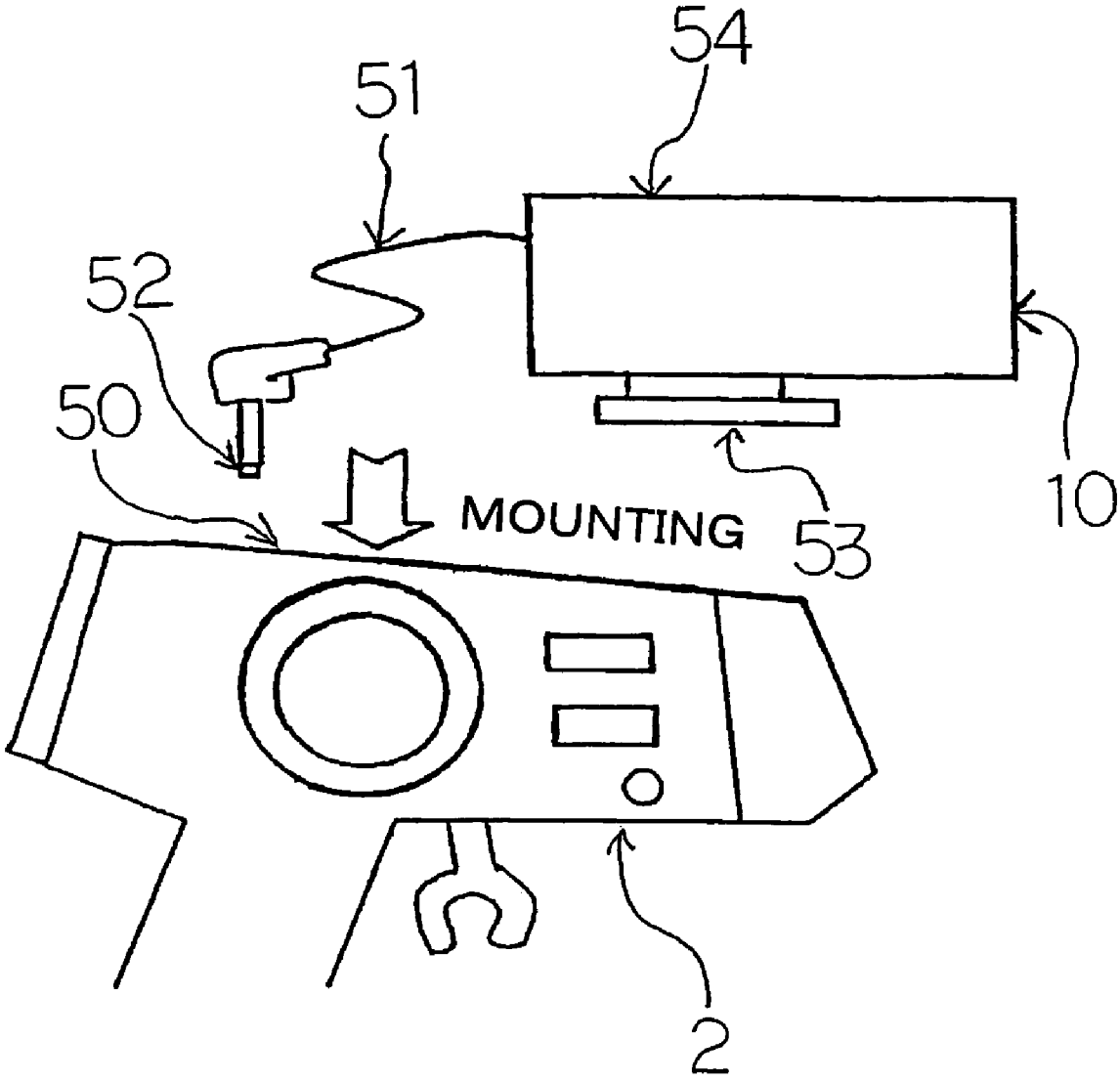
FIG. 10 shows a region of an output terminal of the controller and the extension unit of the second embodiment.

FIG. 10 shows the extension unit 10 and the output terminal 50 which is of the region where the extension unit 10 is mounted. The output terminal 50 is a terminal in which the transmit data 5 can be amplified and electrically output. While the output terminal 50 is provided in a socket shape on an upper surface of the controller 2, the region or shape of the output terminal 50 is not limited to the second embodiment.

The extension unit 10 has a cable 51 which can be connected to the output terminal 50. A connection terminal 52 which can be connected to the output terminal 50 by plugging the connection terminal 52 into the output terminal 50 is provided at one end of the cable 51, and the other end is connected to the extension unit 10. A stabilizing stage 53 is provided in a main body of the extension unit 10 so as to be stably fixed to the controller 2 when the extension unit 10 is mounted on the controller 2. Although the shape of the extension unit 10 is not limited to the illustrated shape, it is desirable that the extension unit 10 has the configuration to mount itself stably on the controller 2. It is desirable that a size of the extension unit 10 and a weight of the extension unit 10 are of the degree that the extension unit 10 does not interfere with the operation of the controller 2 after the extension unit 10 is mounted on the controller 2. It is also possible that the extension unit 10 has the shape for placing at the other place to be used without mounting on the controller 2. Further, it is also possible that an amplification terminal 54 which amplifies and outputs the transmit data 5 is provided in the extension unit 10.

Figure 11:
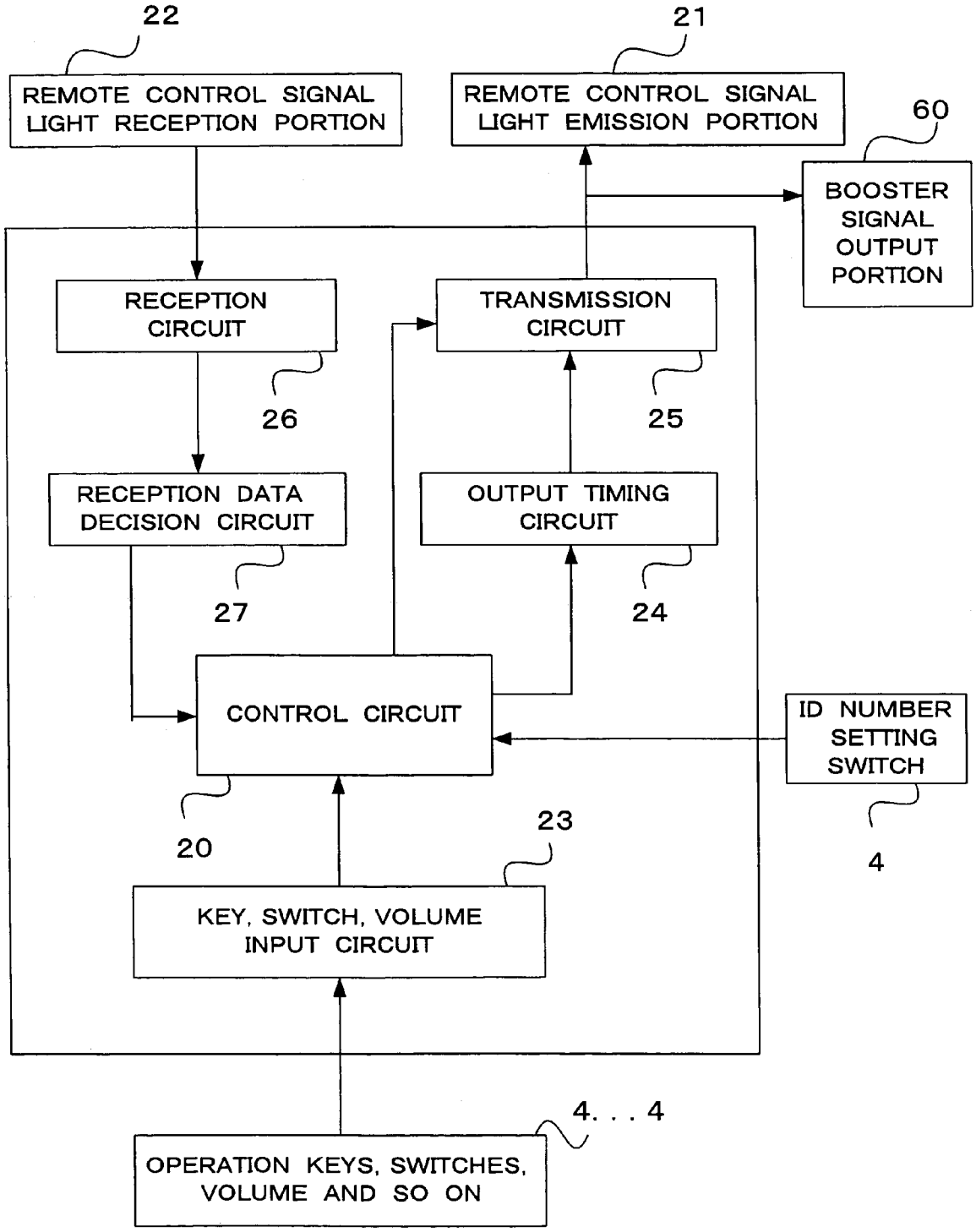
FIG. 11 shows the configuration of the controller of the second embodiment.

Then, the circuit configuration of the controller 2 will be described referring to FIG. 11. An input circuit 23 detects the operation input to the input devices 4 . . . 4 to transmit operation signals according to the operation state to a control circuit 20. In the control circuit 20, the transmit data 5 is produced in accordance with the operation signals. The transmit data 5 is sent to an output timing circuit 24. In the case where it is decided that the own transmit timing comes, the transmit data 5 is transmitted to a remote control signal light emission portion 21 and a booster signal output portion 60 through a transmission circuit 25. The remote control signal light emission portion transmits the transmit data 5 with the infrared rays, and the booster signal output portion 60 outputs the transmit data 5 in a form of digital data. A remote control signal light reception portion 22 receives the transmit data 5 transmitted from the other controller 2. The received transmit data 5 is sent to the control circuit 20 through a reception circuit 26 and a reception data decision circuit 27, and the control circuit 20 controls the own transmit timing.

Figure 12:
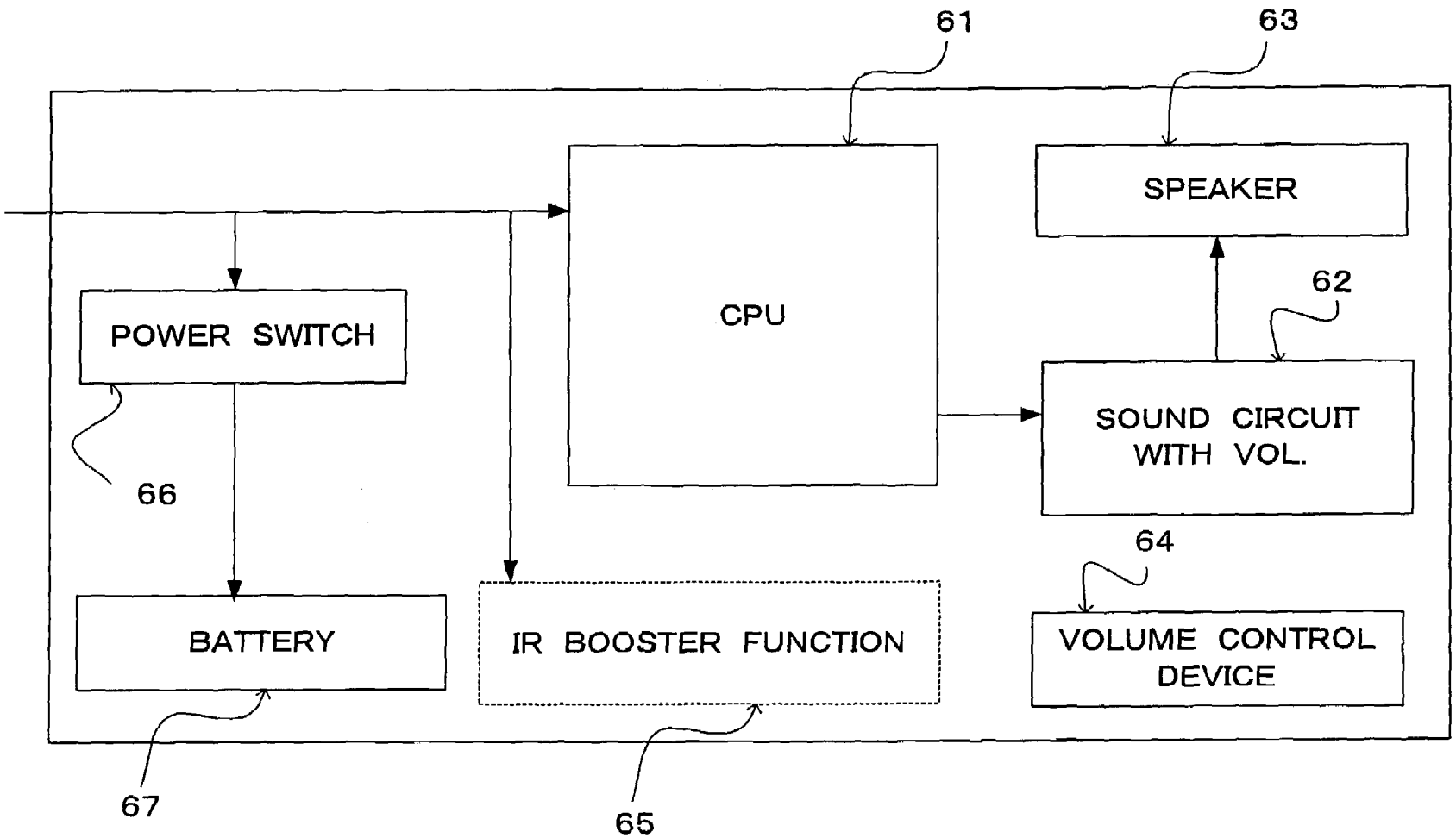
FIG. 12 shows the configuration of the extension unit of the second embodiment.

FIG. 12 shows the circuit configuration of the extension unit 10. The electric power is supplied to the extension unit 10 by a battery 67. Turning a power switch 66 on causes each of the following circuits to become workable. The extension unit 10 has a control circuit 61, a sound circuit 62, a speaker 63, and a volume control device 64. The sound circuit 32 is a circuit for producing the sound data in which the noise is eliminated from the sound source such as the PCM sound source or the FM sound source. The control circuit 61 controls the sound circuit 62. When the transmit data 5 is input through the cable 51, the transmit data 5 is first sent to the control circuit 61 as the code signal obtaining device and the process performing device. In the control circuit 61, the contents of the transmit data 5 are decoded to decide the sound to be output. The decision result is sent to the sound circuit 62 to produce the sound data. The produced sound data is output through the speaker 63. The volume level of the output sound can be controlled by the volume control device 64. It is also possible that the extension unit 10 has an IR booster function 65 which amplifies and outputs the transmit data 5. When the transmit data 5 is input through the connection terminal 52, the transmit data 5 is directly amplified output without passing through the control circuit. The sound effect associated with the action of the running car 1 includes squeaking sound of tires, hissing sound of a car body, the engine sound associated with the acceleration, the engine sound associated with the deceleration, and the like.

Figure 13:
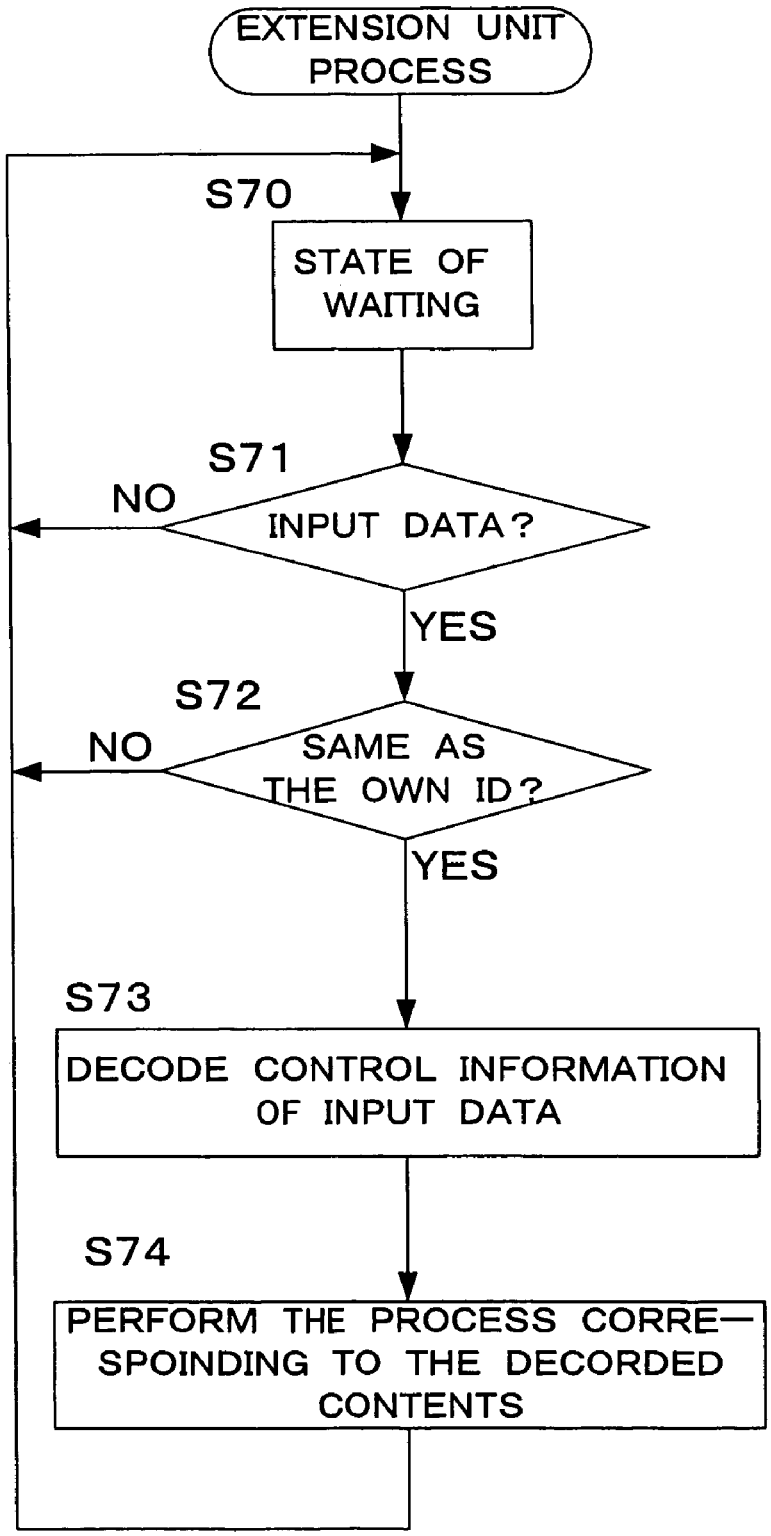
FIG. 13 is a flow chart showing the flow of the process performed by a control circuit of the extension unit of the second embodiment.

FIG. 13 shows the flow of the process performed by the control circuit 61 of the extension unit 10. When the power switch 66 is turned on, the control circuit 61 repeats a state for waiting the input of the transmit data 5 (Step S70) and a state for deciding whether the transmit data 5 has been received or not (Step S71). When the transmit data 5 has been received, the process proceeds to Step S42. In Step S72, when the ID code 6 of the transmit data 5 does not equal to the own ID code, the process returns to Step S40. When the ID code 6 of the transmit data 5 equals the own ID code, the process proceeds to Step S73. In Step S73, the control circuit 61 decodes the contents of the operation direction data 7*a* and 7*b* of the received transmit data 5. After decoding, the process proceeds to Step S74, and the control circuit 61 causes the sound circuit 62 to perform the process corresponding to the received operation direction data 7*a* and 7*b*. Then, the process returns to Step S70 to be in the state for waiting the input.

The invention is not limited to the above-described embodiments, and the invention may be realized in various modifications. For example, with respect to the effect for causing the player to have the realization of the performance of the operation, it is possible to light-emit the extension unit 10 itself or to generate the image enhancing the production effect as well as the sound and vibration.

In the second embodiment, it is also possible that the vibrating motor is provided in the extension unit 10.

In the first embodiment, in the case where the tank has a plurality of types of gun shells to be fired such that the gun shells have different destructive forces, the firing sound and the vibration may be realized in accordance with the type of the gun shell.

As described above, the invention can provide the remote-controlled toy which can enhance the feeling of operating by performing the production such as the sound effect so that the player can realize his/her operation on the transmitter side and which can easily perform the production even if the transmitter has been already produced.

The invention claimed is:

1. A remote-controlled toy comprising: a controller for transmitting code signals in accordance with operation contents of a user; a drive unit to be driven and controlled based on the code signals; and an extension unit to be detachably mounted on the controller, wherein the extension unit has a code signal obtaining device for obtaining the code signals output from the controller and a process performing device for deciding a state of the drive unit based on the obtained code signals to perform a predetermined process based on the decision result are provided in; wherein a charging dock which has a charging terminal to supply electric power for charge to the drive unit is provided in the controller, the charging dock being able to hold the drive unit while the charging terminal is electrically connected to the drive unit, and the extension unit can be mounted on the charging dock; and wherein the extension unit, when mounted on the controller, is adapted to hide the charging terminal, and an extension circuit is provided in the extension unit, the extension circuit connecting the charging terminal of the controller and an extension charging terminal provided at a position of the extension unit which is exposed outside when the extension unit is mounted on the charging dock.

2. The remote-controlled toy according to claim 1, wherein the controller has a transmission portion for transmitting the code signals, and the code signal obtaining device has a reception portion arranged opposite to the transmission portion to receive the code signals transmitted from the transmission portion.

3. The remote-controlled toy according to claim 1, wherein a terminal portion which outputs the code signals is provided in the controller, and the code signal obtaining device is connected to the terminal portion with a wire.

4. The remote-controlled toy according to claims 2 or 3, wherein the extension unit has an amplifying device for amplifying and transmitting the code signals output from the controller.

5. The remote-controlled toy according to claims 1 or 2 wherein the predetermined process includes output of a sound or an image according to a state of the drive unit.

* * * * *

UNITED STATES PATENT AND TRADEMARK OFFICE

CERTIFICATE OF CORRECTION

PATENT NO. : 7,393,260 B2
APPLICATION NO. : 10/506110
DATED : July 1, 2008
INVENTOR(S) : Takashi Yamaguchi It is certified that error appears in the above-identified patent and that said Letters Patent is hereby corrected as shown below:

On the Title Page Item (73)

Please delete "KONAMI CORPORATION, Chiyoda-Ku, Tokyo Japan" and insert -- KONAMI DIGITAL ENTERTAINMENT CO. LTD., Tokyo, Japan --.

Signed and Sealed this

Nineteenth Day of August, 2008

JON W. DUDAS
*Director of the United States Patent and Trademark Office*